US005190017A

United States Patent [19]

Cullen et al.

[11] Patent Number: 5,190,017

[45] Date of Patent: Mar. 2, 1993

[54] EXHAUST GAS RECIRCULATION SYSTEM FAULT DETECTOR

[75] Inventors: Michael J. Cullen, Dearborn; Rogelio G. Samson, Bloomfield Hills; Alistair S. Teasdale, Redford; Richard L. Wanat, Troy, all of Mich.

[73] Assignee: Ford Motor Company, Dearborn, Mich.

[21] Appl. No.: 889,659

[22] Filed: May 28, 1992

[51] Int. Cl.[5] ..... F02M 25/07

[52] U.S. Cl. ..... 123/571; 73/117.3; 364/431.06

[58] Field of Search ..... 123/568, 569, 571; 73/117.3; 364/431.06

[56] References Cited

U.S. PATENT DOCUMENTS

| | | | |
|---|---|---|---|
| 4,375,800 | 3/1983 | Otsuka et al. | 123/571 |
| 4,378,776 | 4/1983 | Nishimori | 123/571 |
| 4,390,001 | 6/1983 | Fujimoto | 123/571 |
| 4,397,289 | 8/1983 | Haka et al. | 123/571 |
| 4,399,799 | 8/1983 | Romblom et al. | 123/571 |
| 4,409,948 | 10/1983 | Hasegawa et al. | 123/571 |
| 4,428,354 | 1/1984 | Sundeen et al. | 123/568 |
| 4,462,376 | 7/1984 | Ripper et al. | 123/571 |
| 4,665,882 | 5/1987 | Otobe et al. | 123/571 |
| 4,715,348 | 12/1987 | Kobayashi et al. | 123/571 |
| 4,793,318 | 12/1988 | Tsurusaki | 123/571 |
| 4,834,054 | 5/1989 | Hashimato et al. | 123/571 |
| 5,014,203 | 5/1991 | Miyazaki et al. | 123/571 |

*Primary Examiner*—Willis R. Wolfe

*Attorney, Agent, or Firm*—Peter Abolins; Roger L. May

[57] ABSTRACT

The method for determining a fault in an exhaust gas recirculation system includes comparing the measured exhaust gas flow of the EGR system to an expected exhaust gas recirculation flow. If the two are not the same the time period that the expected exhaust gas recirculation flow deviates from the measured exhaust gas recirculation flow by a calibrated EGR flow amount is determined. A fault condition in the EGR system is indicated if the duration of the deviation exceeds a predetermined amount of time.

10 Claims, 12 Drawing Sheets

FIG. 1.
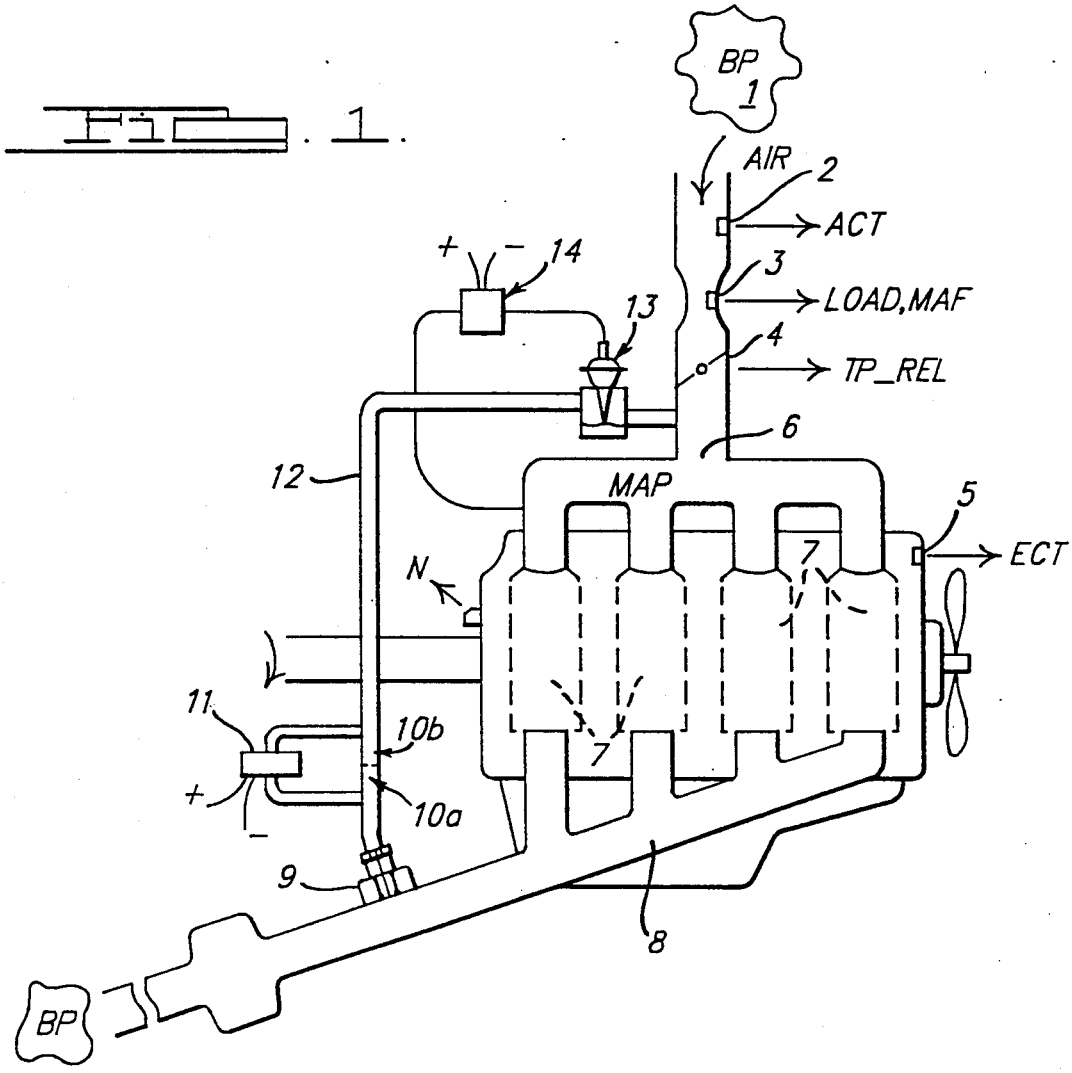
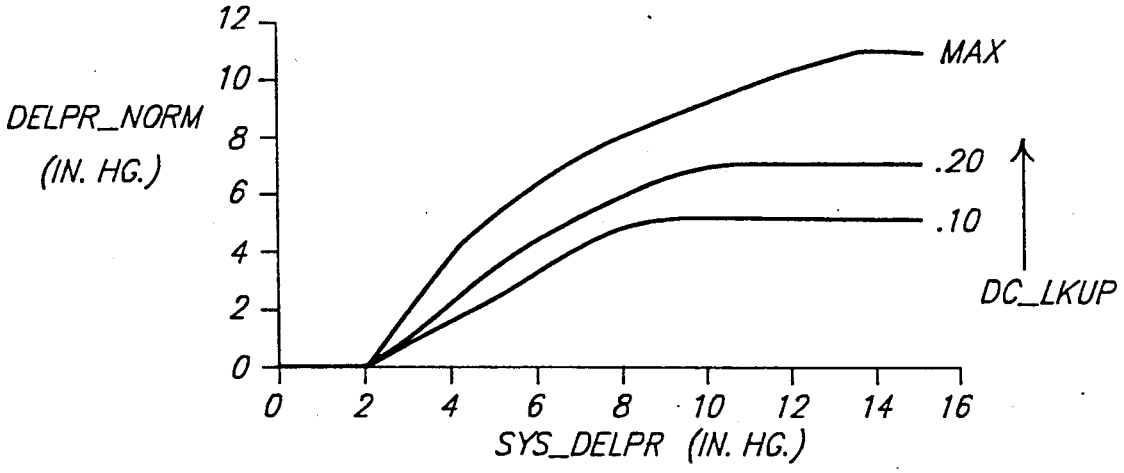
FIG. 2A.

MAIN LOGIC DIAGRAM

EXHAUST GAS RECIRCULATION SYSTEM FAULT DETECTOR

BACKGROUND OF THE INVENTION

1. Field of the Invention

This invention relates to exhaust gas recirculation systems for motor vehicle internal combustion engines.

2. Prior Art

Hasegawa et al, U.S. Pat. No. 4,409,948, discloses an EGR control system, comprising an electronic control unit (ECU) 5, and EGR control valves 21, 22. ECU 5 includes a comparator 38 and memories 31, 39. This system automatically corrects a detected zero opening value of the EGR valve, as compared to a valve opening command of value read from a map of required valve opening values for a predetermined period of time.

Fujimoto, U.S. Pat. No. 4,390,001, discloses an EGR system, including a gas recirculation passage 4, a recirculation control valve 5, solenoid valves 7, 8, a control device 9 and a memory device 15. The memory device 15 stores memories of optimum values. The control device 9 receives a signal corresponding to an optimum value of pressure drop $P_0$ (col. 3, lines 49-55).

Otobe, U.S. Pat. No. 4,665,882, discloses a method of controlling EGR quantity, comprising an EGR valve 16, and a CPU 27 incorporating timers for fault detection, and a RAM 28 and a ROM 29. The ROM 29 stores various maps and tables for calculating the lifting amount of the EGR valve. 16. The October patent teaches a position feedback sensor whereas Applicants teach using a pressure feedback electronic control.

U.S. Pat. No. 4,665,882 compares a desired position to an actual position, and uses lack of achieving the desired position as a fault. Applicants use redundant information available from models of the EGR components to obtain an independent calculation of the expected delta pressure. There is no comparison of desired value to actual value. There is a comparison of model value to actual value.

The '882 patent teaches keeping track of the time at which the error occurs and triggers if this time exceeds a value. It also teaches keeping track of the number of times an error occurs in a given time. There is no provision to count down. Applicants' error counter, active after several gate conditions are achieved, counts a counter up when there is an error, and also counts down when there is not.

However, actual EGR position may not equal the desired position. The most common reason is lack of EGR muscle vacuum at low engine vacuums (high throttle positions). Such a situation can occur at high altitude. Patent '882 teaches a gate on ACT and on ECT. Applicants' invention has neither.

Haka et al, U.S. Pat. No. 4,397,289, discloses an EGR system incorporating a transducer 42 and a control system 72. The control system 72 responds to selected engine operating parameters in order to vary the reference pressure with which the control pressure in the zone 53 is compared.

U.S. Pat. No. 4,834,054, issued to Hashimoto et al, is a fault detector based on EGR temperature The '054 patent has a gate on barometric pressure (BP) In contrast, Applicants' invention teaches a gate on manifold vacuum which is in turn calculated from BP.

SUMMARY OF THE INVENTION

Applicant's invention relates to the exhaust gas recirculation (EGR) system of an internal combustion engine and includes a method for comparing two independent methods of estimating the exhaust gas flow through the EGR system, in order to determine whether one of the EGR system components has become inoperable. If the two estimates deviate by a calibrated amount for a sustained period of time, then a fault condition in the EGR system is indicated.

The first estimate of EGR flow, termed DELPR (a pressure typically expressed in inches of $H_2O$), is a direct measurement of the pressure drop across an EGR metering orifice within the EGR tube assembly with a pressure sensor.

The second estimate, termed DELPR_NORM in Inches of H20, is a model of the expected pressure drop across the EGR orifice as a function of other inputs and ROM constants stored in an electronic engine control computer. For a specific engine, EGR valve, metering orifice and tube assembly, a characteristic function, DELPR_NORM, is developed on a dynamometer as a function of the EGR electronic vacuum regulator (EVR) duty cycle and the total pressure drop across the EGR tube assembly (SYS_DELPR). This total pressure drop is equal to the gauge exhaust pressure, inferred from air mass flow, plus the manifold vacuum, inferred from air mass flow, barometric pressure and other variables. The resulting characteristic function, which is stored in an electronic engine control (EEC_IV) memory, indicates the expected pressure drop across the metering orifice when a potential pressure drop, SYS_DELPR, is available and the EGR valve is opened by an amount related to the EVR duty cycle.

Deviations of the measured metering orifice pressure drop, DELPR, from the expected pressure drop based on redundant sensors, DELPR_NORM, indicates various modes of in-range faults in the EGR system. The failures which can be detected include: restricted or plugged EGR valve, restricted or plugged EGR metering orifice, and a stuck open EGR valve.

BRIEF DESCRIPTION OF THE DRAWINGS

FIG. 1 is a schematic view of an exhaust gas recirculation system and associated engine in accordance with an embodiment of this invention;

FIG. 2A is a graphical representation of an exhaust gas recirculation system hardware characteristic function stored in read only memory as a table wherein the model of expected metering orifice pressure drop is a function of total pressure drop across the EGR tube/valve assembly and the electronic vacuum regulator duty cycle relative to the start to open value.

DETAILED DESCRIPTION OF THE INVENTION

Figure 2B:
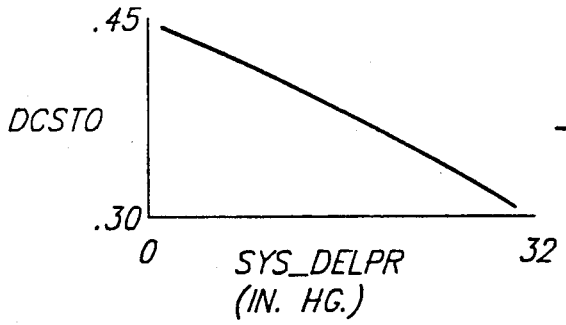
FIG. 2B is the electronic vacuum regulator start to open value versus the pressure drop across the EGR valve when it is in its closed position, which is SYS_DELPR.

The invention is used in conjunction with a number of pressure feedback type EGR systems. Such systems may differ in the calculation of DELPR, the pressure drop across the metering orifice. A DPFE system directly measures DELPR. A PFE system measures the downstream pressure, DP, and infers the upstream pressure, PE, from the engine air mass flow. DELPR is calculated as DP-PE. This description of the invention refers to DELPR without regard to which of these two methods are used to determine it.

For purposes of discussion and description, the following definitions are useful. The designations for inputs used in the EGR system diagnostics are:

RPM—engine speed (revolutions/minute), a sensor input.

AM—air mass flow (lbs/minute), a sensor input from a mass air meter, or derived from a vane air meter and barometric pressure, or calculated from manifold pressure and other variables in speed-density systems.

AIRCHG—air charge (lbs/cylinder-filling) which equals (AM lbs/minute) divided by the number of cylinder fillings per minute:

$$AIRCHG=AM/(RPM*ENGCYL/2)$$

ENGCYL is the number of engine cylinders.

EGRACT—actual EGR percent (%), a sensor input.

BP—barometric pressure (in.Hg.), a sensor input or inferred from other logic.

EXHT—exhaust temperature (Deg. K.), a sensor input or inferred from other logic.

EGRDC—the duty cycle of the current applied by the EEC-IV to the electronic vacuum regulator, EVR, which in turn passes manifold vacuum to the EGR valve.

EGREN—a logical variable indicating that other EEC-IV logic has requested a non-zero amount of EGR.

DELPR—a direct sensor input of the delta pressure across the EGR metering orifice.

BG_TMR—a calculated EEC_IV variable indicating the time between successive background program loops.

The designation used for the outputs for the EGR system fault detector are:

EGR_DNHOSE_CODE—a variable indicating that the downstream hose of the DPFE sensor has become disconnected.

EGR_VLVPLG_CODE—a variable indicating that the EGR valve is restricted or that the EGR tube is smashed.

EGR_VLVOPN_CODE—a variable indicating that the EGR valve is stuck in the open position.

EGR_RESORF_CODE—a variable indicating that the EGR metering orifice is restricted, as indicated by a high DELPR.

EGR_UNSTAB_CODE—a variable indicating that the EGR metering orifice is restricted, as indicated by a lack of stability.

The designation for calibration items used in the EGR system fault detector are:

ENGCYL—number of engine cylinder (=8 for 8 cylinder engine).

EGRMULT(RPM,AIRCHG)—a table containing the change in manifold pressure, MAP, per percent of exhaust gas recirculation, EGRACT.

INT(RPM)—a table containing the manifold pressure, MAP, at zero air charge, AIRCHG.

SLOPE(RPM)—a table containing the increase in manifold pressure, MAP, with a unit of air charge, AIRCHG.

MULT(BP)—an adjustment to exhaust backpressure, PEXH STP, for barometric pressure, BP.

PEXH_STP(AM)—a table containing the exhaust system backpressure versus engine air mass flow at a standard temperature and pressure.

DCSTO(SYS_DELPR)—a table containing the EGR duty cycle required for the EGR valve to start to open versus the delta pressure across the EGR system, SYS_DELPR.

DELPR_NORM(SYS_DELPR, DC_LKUP)—a table containing the expected delta pressure across the EGR metering orifice, DELPR, for a EGR system with no faults, versus the total pressure drop across the EGR tube/valve assembly, SYS_DELPR, and the EGR duty cycle, EGRDC, adjusted for the start to open value, DCSTO.

MIN_MVAC_FOR_EGR_TESTS—the minimum manifold vacuum, MVAC, to enable the setting of variable VAC_RNG_FLG, which in turn is referenced by some of the EGR fault detectors.

MAX_MVAC_FOR_EGR_TESTS—the maximum manifold vacuum, MVAC, to enable the setting of variable VAC_RNG_FLG, which in turn is referenced by some of the EGR fault detectors.

RPMMAX_EGR—the maximum engine RPM to enable the setting of variable ENG_STDY_FLG, which in turn is referenced by some of the EGR fault detectors.

TCEGRDC_BAR—the time constant used to smooth the EGR EVR duty cycle, EGRDC, to produce the variable EGRDC_BAR, the indication of steadiness.

EGRDC_SSTOL—the change in EGRDC over EGRDC_BAR below which the variable EGR_STDY_TMR is incremented.

EGR_STDY_TM—the time in seconds EGRDC must be below EGRDC_SSTOL before the variable EGR_STDY_FLG is set to 1. EGR_STDY_FLG is used by some of the EGR fault detectors.

DELPR_THRES1—the EGR delta pressure, DELPR, above which the downstream hose fault counter is set to zero.

EGRDELPR_TOL—the amount DELPR can deviate from exhaust backpressure, PEXH, in a plus or minus direction, and result in the downstream hose fault counter and the upstream hose fault counter being set to zero.

EGR_DNHOSE_FAULT_COUNTER—the number added to the downstream hose fault counter upon meeting all of the fault criteria for one loop through the calculations.

DELPR_THRES2—the negative EGR delta pressure, DELPR, below which the upstream hose fault counter is set to zero.

EGR_UPHOSE_FAULT_UPSTEP—the number added to the upstream hose fault counter upon meeting all of the fault criteria for one loop through the calculations.

V_EGRDC_MAX—the EGRDC below which the EGR valve plugged fault counter is cleared.

DC_VLVPLG—the duty cycle used to determine variable DELPR_MIN_VLVPLG from the DELPR_NORM table for use in the EGR valve plug fault logic.

EGR_VLVPLG_FAULT_UPSTEP—the number added to the upstream hose fault counter upon meeting all of the fault criteria for one loop through the calculations.

EGRDC_LIM_VO—the EGRDC above which the EGR valve stuck open fault counter is cleared.

DELPR_MAX_VLVOPN—the DELPR above which the EGR valve stuck open fault counter is incremented.

EGR_VLVOPN_FAULT_UPSTEP—the number added to the EGR valve stuck open fault counter upon meeting all of the fault criteria for one loop through the calculations.

EGRDC_LIM_ROU—the EGRDC above which the EGR restricted orifice fault counter is cleared.

EGRDC_LIM_ROL—the EGRDC below which the EGR restricted orifice fault counter is cleared.

DC_RESORF—the duty cycle used to determine variable DELPR_MAX_RESORF from the DELPR_NORM table for use in the EGR restricted orifice fault logic.

EGR_RESORF_FAULT_UPSTEP—the number added to the EGR restricted orifice fault counter upon meeting all of the fault criteria for one loop through the calculations.

EGRDC_LIM_VU—the amount the EEC-IV commanded EGR duty cycle, EGRDC, can change from one calculation loop to the next, and indicate a potential unstable EGR system.

EGR_UNSTAB_FAULT_UPSTEP—the number added to the EGR unstable fault counter upon meeting all of the fault criteria for one loop through the calculations.

EGR_DNHOSE_FAULT_THRESHOLD—the number, if exceeded by EGR_DNHOSE_FAULT_COUNTER, causes the malfunction indicator light to be illuminated and the appropriate fault code to the stored for reference by a service technician.

EGR_UPHOSE_FAULT_THRESHOLD—the number, if exceeded by EGR_UPHOSE_FAULT_COUNTER, causes the malfunction indicator light to be illuminated and the appropriate fault code to be stored for reference by a service technician.

EGR_VLVPLG_FAULT_THRESHOLD—the number, if exceeded by EGR_VLVFLG_FAULT_COUNTER, causes the malfunction indicator light to be illuminated and the appropriate fault code to be stored for reference by a service technician.

EGR_VLVOPN_FAULT_THRESHOLD—the number, if exceeded by EGR_VLVOPN_FAULT_COUNTER, causes the malfunction indicator light to be illuminated and the appropriate fault code to be stored for reference by a service technician.

EGR_RESORF_FAULT_THRESHOLD—the number, if exceeded by EGR_RESORF_FAULT_COUNTER, causes the malfunction indicator light to be illuminated and the appropriate fault code to be stored for reference by a service technician.

EGR_UNSTAB_FAULT_THRESHOLD—the number, if exceeded by EGR_UNSTAB_FAULT_COUNTER, causes the malfunction indicator light to be illuminated and the appropriate fault code to be stored for reference by a service technician.

FIG. 1 depicts a pressure feedback electronic (PFE) EGR system installed on an engine. Air enters an air cleaner at barometric pressure (termed BP, units inches Hg.). Air temperature is measured by a temperature sensor and the output is termed ACT in degrees F. Alternately, the temperature sensor is in an intake manifold 6. Air mass flow is measured by a hot-wire air meter 3 and the output is termed MAF in lbs/min. In an electronic engine control module, it is also converted to air charge in lbs/cylinder-filling and termed AIRCHG. The throttle position is measured by a potentiometer and the output is termed TP_REL in counts. The engine coolant temperature is measured by a temperature sensor and the output is termed ECT in degrees F. The exhaust manifold is shown at numeral 8. The gauge exhaust pressure (termed PE in inches H20) is inferred in the engine control module is a function of engine air mass flow (MAF) which approximately equals the exhaust mass flow by conservation of mass. The EGR tube is fastened by a machine screw fitting 9 to a boss on exhaust manifold 8.

If the EGR valve is open, a portion of exhaust gas enters a tube 12. The exhaust gas flows through a PFE EGR metering orifice 10*a–b*. For a DPFE system, the delta pressure across metering orifice 10 is measured by a DPFE sensor 11 and the variable is termed DELPR in inches of water. For a PFE system, only the upstream pressure is measured via a pressure tap orifice in 10*b*. EGR valve 13 opens and closes the passage from the EGR tube to intake manifold 6. The EGR flow mixes with the fresh air flow and the percentage of EGR is the quantity that is scheduled and controlled. The percent is termed EGRATE (percent) when it is the desired amount, and is termed EGRACT (percent) when it is calculated based on the pressure drop across EGR metering orifice 10. The degree to which the EGR valve is open is controlled by an electronic vacuum regulator (EVR) 14, which is controlled by an electric current. The current is turned on and off at a duty cycle which is termed EGRDC, a 0–1 number. Manifold vacuum is fed to the EVR via a tube 15 which in turn meters the vacuum to the vacuum motor on the EGR valve to actually open and close the valve.

Knowledge of absolute and gauge pressures is used by the invention. Barometric pressure BP (in.Hg.) is inferred using known techniques or can be measured using a barometric pressure sensor. The gauge exhaust backpressure PE (in.H20) at 8 is inferred using known techniques from the measured air mass flow MAF (lbs/min).

$PE = F1(MAF)*29.92/F2(BP)$. where F1 and F2 are ROM data.

The manifold pressure INF_MAP (in.Hg.) at 6 is inferred from measured engine speed and measured air mass using logic in accordance with an embodiment of this invention.

```
INF_MAP = (AIR_MAP_B0 + AIR_MAP_B1*N +
AIR_MAP_B2*N**2) * BP/29.92 +
AIR_MAP_B3*AIRCHG + AIR_MAP_B4*EGRACT
```

where AIR_MAP_B0 to AIR_MAP_B4 are regression coefficients sorted in ROM, and N, EGRACT, AIRCHG were described above. The manifold vacuum INF_MVAC (in. Hg.), also at 6, is calculated from INF_MAP and BP.

$INF_MVAC = BP - INF_MAP$

The pressure drop across across the EGR metering orifice DELPR (in.H20) at 10a-10b is measured directly when the system includes the DPFE sensor. Alternately, if the PFE system is used the output of the sensor is DP (in.H20) at 10b. In this case DELPR is calculated by subtracting the DP from the exhaust backpressure PE.

$DELPR = PE - DP$

SYS_DELPR (in.H20) is calculated from inferred manifold vacuum at 6 plus inferred PE at 8 and equals the pressure drop across the whole EGR tube/valve assembly.

$SYS_DELPR = MVAC + PE/13.6$

The above parameters cam be used in various algorithms. First, a restriction in the EGR tube or EGR valve can be detected. Referring to FIG. 2A, if the commanded electronic engine control EGR duty cycle (DC_LKUP) is higher than a calibrated amount EGRDC_MIN_FOR_EGR_VALVE_FAULT, with values on the order of 0.4 or 40 percent, then the EGR valve is assumed to be fully open. If the measured DELPR is less than the characteristic value, DELPR_NORM, by a calibrated amount, DELPR_TOL_FOR_EGR_VALVE_FAULT, for a sustained period of time, then a restricted EGR valve or EGR tube is indicated. Known fault counter methodology is employed to keep track of faults, and light the malfunction indicator light if this condition is sustained. The fault is only checked over a limited range of manifold vacuums (variables MIN_MVAC_FOR_EGR_TESTS and MAX_MVAC_FOR_EGR_TESTS) and under relatively steady-state conditions where the signal to noise ratio is favorable.

DELPR_NORM = look-up table of (SYS_DELPR, EGRDC) which is plotted in FIG. 2A.

Second, a restriction can be detected, referring to FIG. 2A., if the measured DELPR is greater than the characteristic value, DELPR_NORM, by a calibrated amount, DELPR_TOL_FOR_EGR_ORIFICE_FAULT, for a sustained period of time, then a restricted EGR metering orifice is indicated. Known fault counter methodology can be employed to keep track of faults, and light a malfunction indicator light if this condition is sustained. The fault is only checked over a limited range of manifold vacuums, and limited range of EGRDCs EGRDC_MIN_FOR_EGR_ORIFICE_FAULT to EGRDC_MAX_FOR_EGR_ORIFICE_FAULT, and under relatively steady-state conditions where the signal to noise is favorable.

Third, an EGR valve stuck in the open position can be detected if the EGRDC is low and the DELPR is very high, then the EGR valve must be stuck open. If the commanded engine control EGR duty cycle (EGRDC) is lower than a calibrated amount, EGRDC_MIN_FOR_EGR_STUCK_OPEN_FAULT known to correspond to a closed EGR valve, then the measured DELPR should be less than a calibrated amount DELPR_MAX_FOR_EGR_STUCK_OPEN_FAULT which is close to zero. If the measured DELPR is larger than this calibrated value for a sustained period of time, then an EGR valve in the stuck open position is indicated. Known counter methodology can be employed to keep track of faults, and light a malfunction indicator light if this condition is sustained. The fault is only checked over a limited range of manifold vacuums (variables MIN_MVAC and MAX_MVAC) and under relatively steady-state conditions where the signal to noise is favorable.

Fourth, there is a secondary means for detection of EGR metering orifice restrictions. The logic detects restricted EGR metering orifices under relatively steady conditions. Severely plugged orifices will result in out of control oscillations of the feedback control mechanism. These oscillations are caused by the increased sensitivity of the EGR system with small orifices (small changes in valve flow rate change the delta pressure dramatically). Under oscillating conditions, phase shifts can cause the noted logic to malfunction. A secondary fault check is required to detect out of control oscillations.

The following logic (summarized in FIG. 6B) detects out of control oscillations in the control duty cycle (EGRDC) as illustrated by FIG. 6A. Oscillations are detected since the fault counter counts up faster than it counts down. Flag EGREN indicates that the EGR system is enabled while flag EGRFLG is used to avoid checking on the first pass through the logic when it is first enabled.

Referring to FIGS. 3A through 3E, a logic sequence is presented which determines whether conditions are proper for doing an exhaust gas circulation diagnostic test. In block 301 the test is entered and logic flow goes to block 302 wherein there is a calculation of SYS_DELPR, INF_MVAC, PEXH and DCSTO. The logic of block 302 is further explained in FIG. 4 Logic flow then goes to block 303 wherein INF_MVAC is tested whether it is greater than the minimum vacuum required for an exhaust gas recirculation test. If not, logic flow goes to block 306 wherein a flag is set equal to zero indicating that it is out of the appropriate vacuum range. If yes, logic flow goes to block 304 wherein it is checked if INF_MVAC is less than the maximum MVAC for an EGR test. If not, logic flow again goes to block 306 where there is an indication that the vacuum is out of range. If yes, logic flow goes to a block 305 wherein a flag is set to one indicating that the vacuum is within range.

Logic flow from blocks 305 and 306 both go to a block 309 wherein the actual rpm is compared to a maximum rpm appropriate for an EGR test. If actual rpm is not less, logic flow goes to a block 311 wherein a flag is set equal to zero indicating the engine is not steady. If actual rpm is less, logic flow goes to a block 310 wherein a flag is set equal to one indicating the engine is steady. Logic flow from blocks 310 and 311 goes to a block 312 wherein a rolling average exhaust gas recirculation duty cycle EGRDC_BAR is a function of the previous rolling average of the exhaust gas circulation duty cycle and a stored scaler time constant.

Logic flow from block 312 goes to a block 313 wherein EGRDC is compared to the EGRDC_BAR plus EGRDC_SSTOL. If it is not less, logic goes to a block 316 wherein a timer is reset to zero as soon as the system is not steady. If EGRDC is less, logic flow goes to a block 314 wherein an EGRDC is compared with the difference at the same parameters (EGRDC_BAR-EGRDC_SSTOL) to see whether it is greater. If not, logic flow again goes to block 316. If yes, logic flow goes to a block 315 wherein EGR steady state timer is incremented using EGR_STDY_TMR=EGR_STDY_TMR+BG_TMR. Logic flow from blocks 315 and 316 goes to a block 317 wherein EGR steady state timer is compared to EGR steady state time, if is not greater logic flow goes to a block 319 wherein EGR is defined as being non-steady and the flag is set to zero. If it is greater, logic flow goes to a block 318 wherein EGR is determined to be steady and a flag is set to one.

Logic flow from both blocks 318 and 319 goes to a block 320 wherein it is checked for a disconnection of the downstream hose. The logic within block 320 is further explained in FIG. 3D. Logic flow then goes a block 321 wherein a disconnection of the upstream hoses is checked. The logic within block 321 is further explained in FIG. 3E. Logic then goes to a block 323 wherein there is a check for a restricted or plugged EGR valve. The logic within block 323 is further discussed in FIG. 5. Logic flow then goes to a block 324 wherein there is a check for a stuck EGR valve in the open position. The logic within block 324 is further explained in FIG. 6. Logic flow then sequentially goes to a block 325 wherein there is a check for restricted EGR metering orifice by a high delta pressure, (the logic within block 325 is further explained in FIG. 7) a block 326 wherein there is a check for a restricted EGR metering orifice via oscillations in the EGR duty cycle, (the logic within block 326 is further explained in FIG. 8A) a block 327 wherein there is logic to activate the malfunction indicator light if it needs to be illuminated. Logic flow then goes to a block 329 wherein there is return to other electronic engine control logic.

Figure 3A:
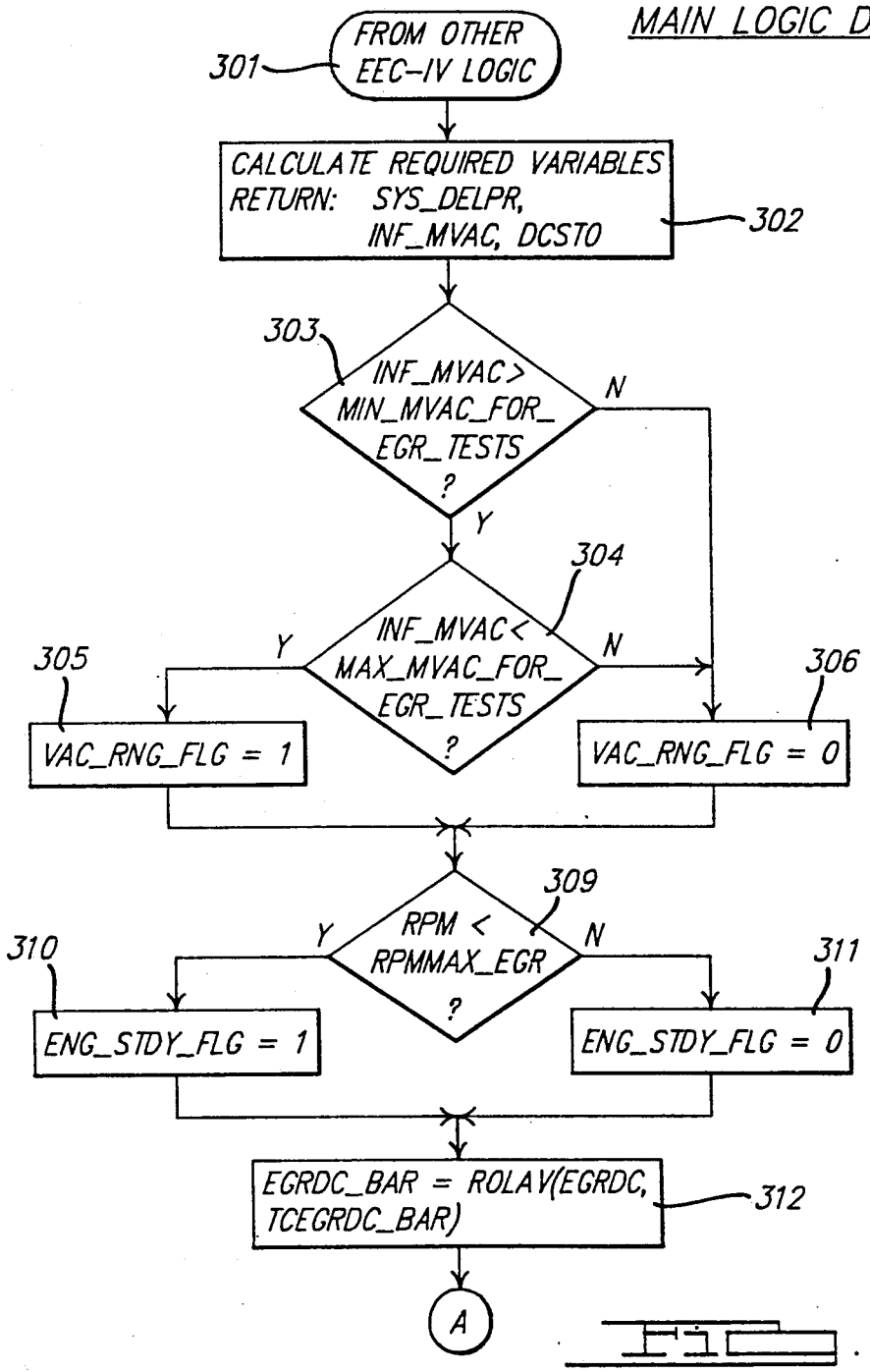
FIGS. 3A, 3B, 3C, 3D and 3E are logic flow diagrams which would be inserted in a normal electronic engine control sequence of background calculations to check EGR operation.
Figure 3B:
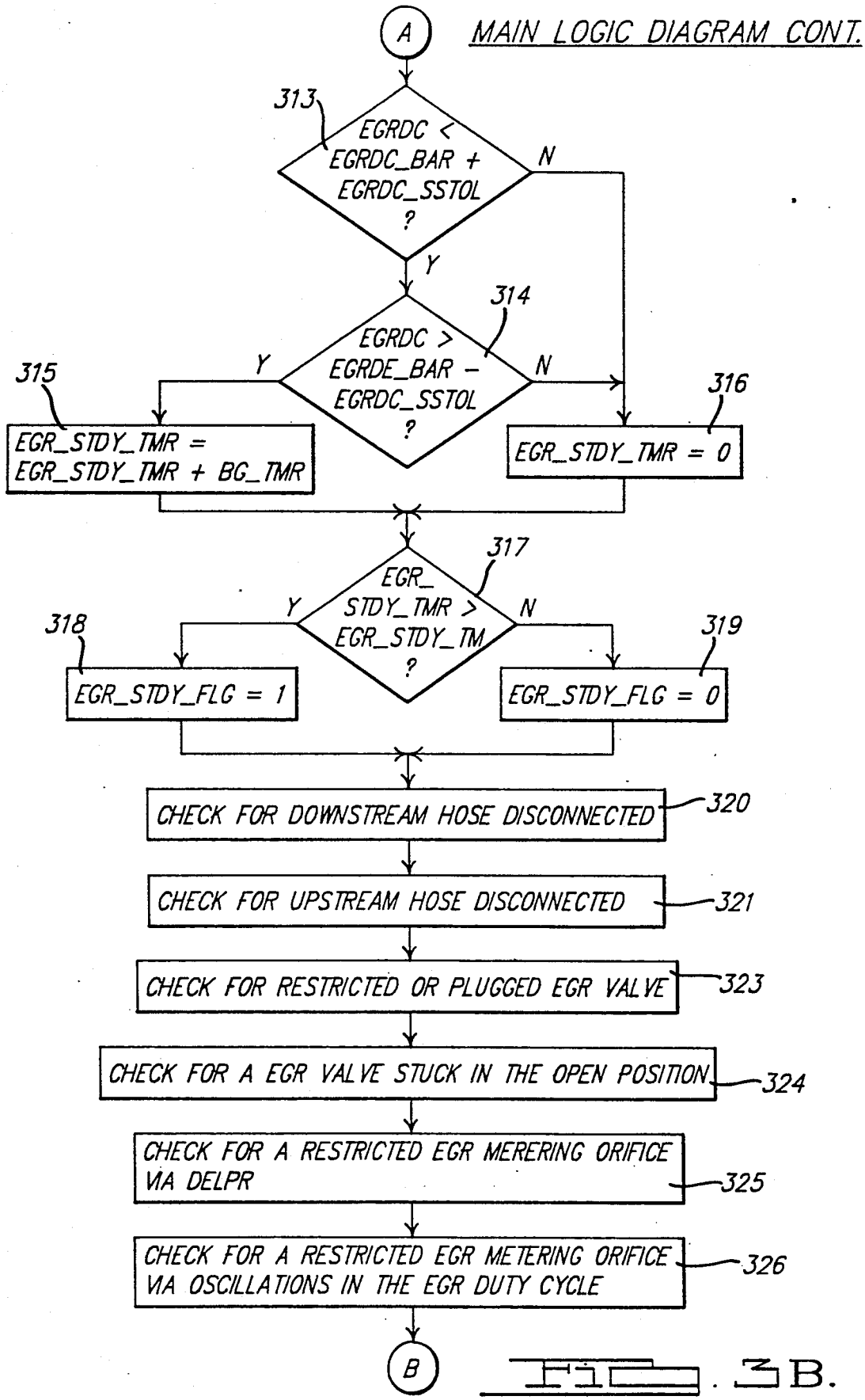
Figure 3C:
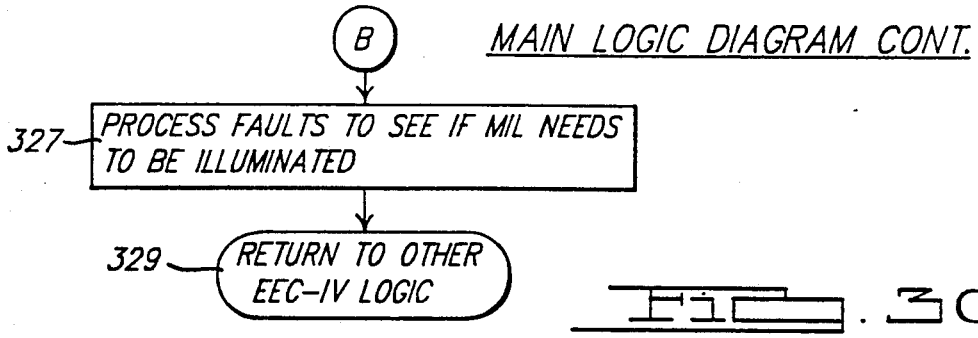
Figure 3D:
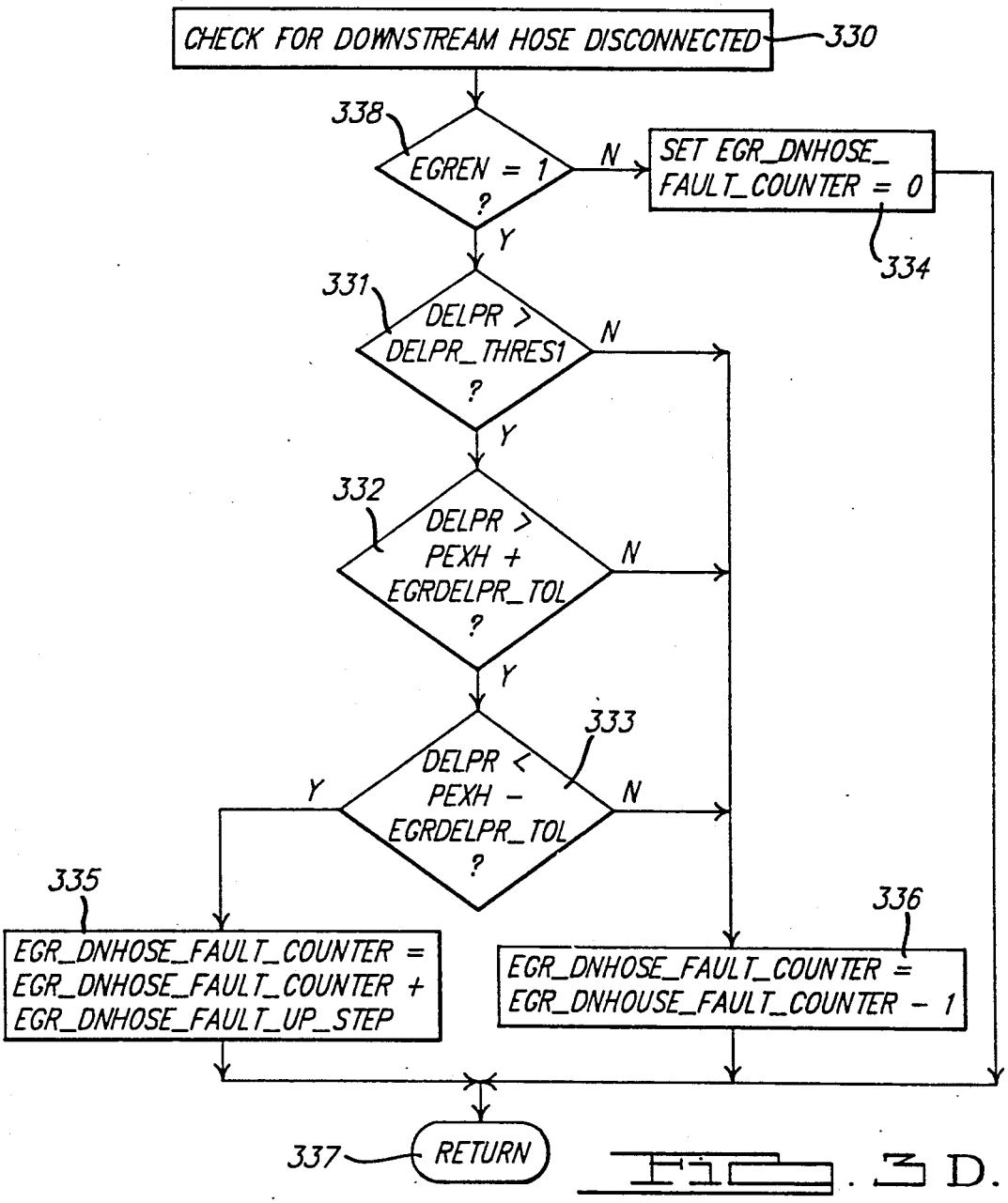

Referring to FIG. 3D, there is a more detailed explanation of the logic of block 320 at FIG. 3B. At block 330 there is the start of a check for a downstream hose disconnection. At block 338 there is tested to see if EGR is enabled (EGREN). This flag is EGREN input 424. That is, if a non-zero EGR flow is requested then EGREN is a flag set equal to one.

If EGREN is not equal to 1.0, then logic flows to block 334 where variable EGR_DNHOSE_FAULT_COUNTER is set to zero, indicating that fault detection cannot take place. Then logic flow is to block 337, a return to the main logic flow diagram in FIG. 3B. If DELPR is equal to 1.0 than then logic flows to decision block 331.

In decision block 331, a comparison is made between DELPR input 408 and calibration variable DELPR_THRES1. If DELPR is not greater than DELPR_THRES1, then logic flows to block 336 where variable EGR_DNHOSE_FAULT_COUNTER is decremented by the constant 1.0, since a fault was not indicated for this loop through the logic. If DELPR is greater than DELPR_THRES1, then logic flows to decision block 332.

In decision block 332, a comparison is made between DELPR input 408 and the sum of calculated variable PEXH and the calibration variable EGRDELPR_TOL. If DELPR is not greater than the quantity (PEXH+EGRDELPR_TOL) then logic flow goes to block 336. If DELPR is greater than the quantity (PEXH+EGRDELPR_TOL) then logic flows to decision decision block 333.

In decision block 333, a comparison is made between DELPR input 408 and the difference of calculated variable PEXH and the calibration variable EGRDELPR_TOL. If DELPR is not less than the quantity (PEXH−EGRDELPR_TOL) then logic flow goes to block 336. If DELPR is less than the quantity (PEXH−EGRDELPR_TOL) then logic flows to decision block 335, where calculated variable EGR_DNHOSE_FAULT_COUNTER is incremented by calibration variable EGR_DNHOSE_UP_STEP, since a fault was indicated this loop through the logic. Logic then flows to block 337.

Figure 3E:
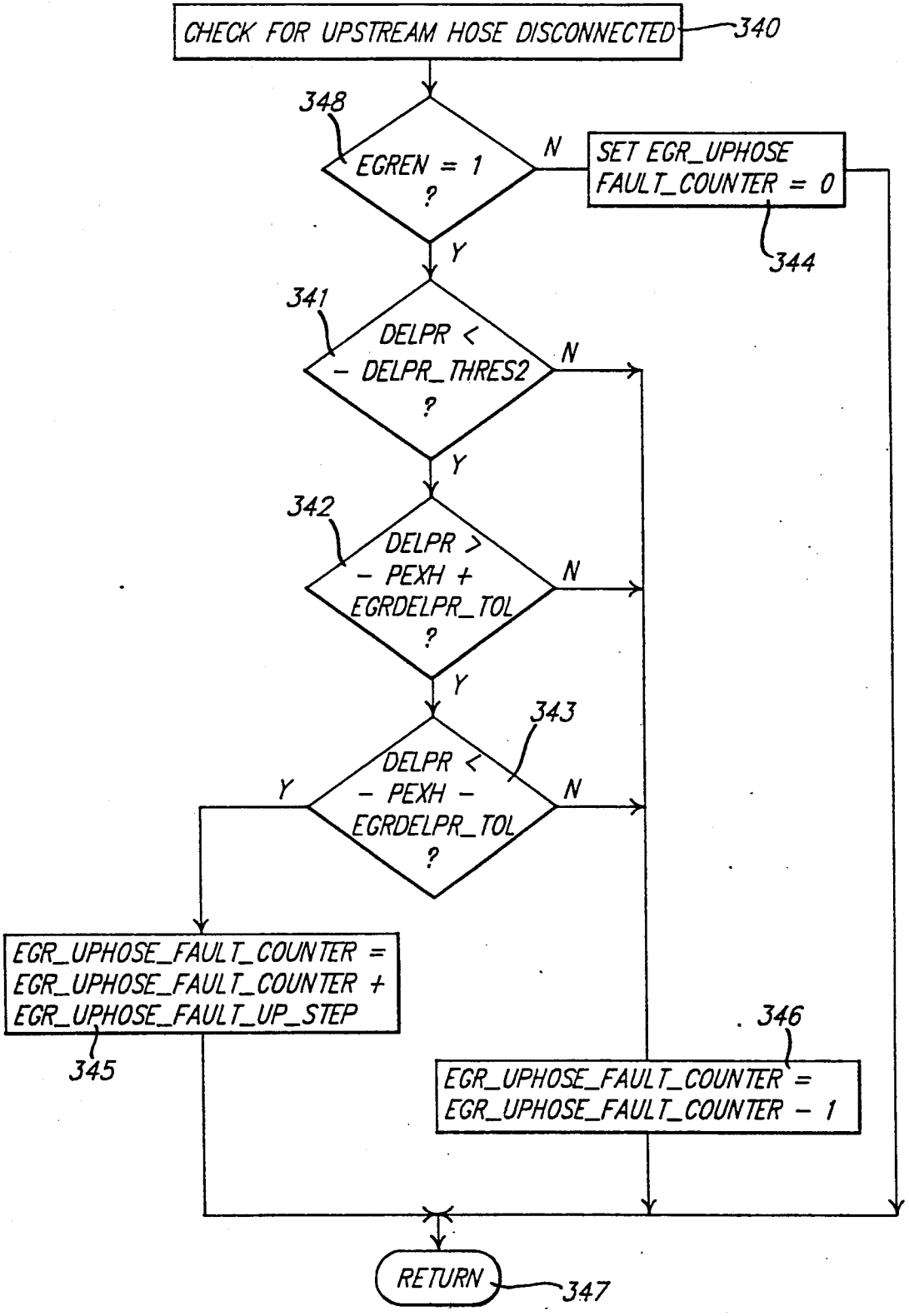

Referring to FIG. 3B, block 321, logic then flows to FIG. 3E, block 340, wherein logic to check for upstream hose disconnected is initiated.

Logic then flows to decision block 348, where a comparison is made between EGREN input 424 and the constant 1.0. If EGREN is not equal to 1.0, then logic flows to block 344 where variable EGR_UPHOSE_FAULT_COUNTER is set to zero, indicating that fault detection cannot take place. Then logic flow to block 347, a return to the main logic diagram in FIG. 3*b*, block 320. If EGREN is equal to 1.0 then logic flows to decision block 341.

In decision block 341, a comparison is made between DELPR input 408 and calibration variable DELPR_THRES1. If DELPR is not less than negative value of DELPR_THRES2, then logic flows to block 346 where variable EGR_UPHOSE_FAULT_COUNTER is decremented by the constant 1.0, since a fault was not indicated for this loop through the logic. Then logic flows to block 347, a return to the main logic flow diagram in FIG. 3*b*, block 321. If DELPR is less than the negative of DELPR_THRES2, then logic flows to decision block 342.

In decision block 342, a comparison is made between DELPR input 408 and the sum of the negative of calculated variable PEXH and the calibration variable EGRDELPR_TOL. If DELPR is not greater than the quantity (−PEXH+EGRDELPR_TOL) then logic flow goes to block 346. If DELPR is greater than the quantity (−PEXH+EGRDELPR_TOL) then logic flows to decision decision block 343.

In decision block 343, a comparison is made between DELPR input 408 and the difference of the negative of the calculated variable PEXH and the calibration variable EGRDELPR_TOL. If DELPR is not less than the quantity (−PEXH−EGRDELPR_TOL) then logic flow goes to block 346. If DELPR is less than the quantity (−PEXH−EGRDELPR_TOL) then logic flows to decision block 345, where calculated variable EGR_UPHOSE_FAULT_COUNTER is incremented by calibration variable EGR_UPHOSE_UP_STEP, since a fault was indicated this loop through the logic. Logic then flows to block 347.

Figure 4:
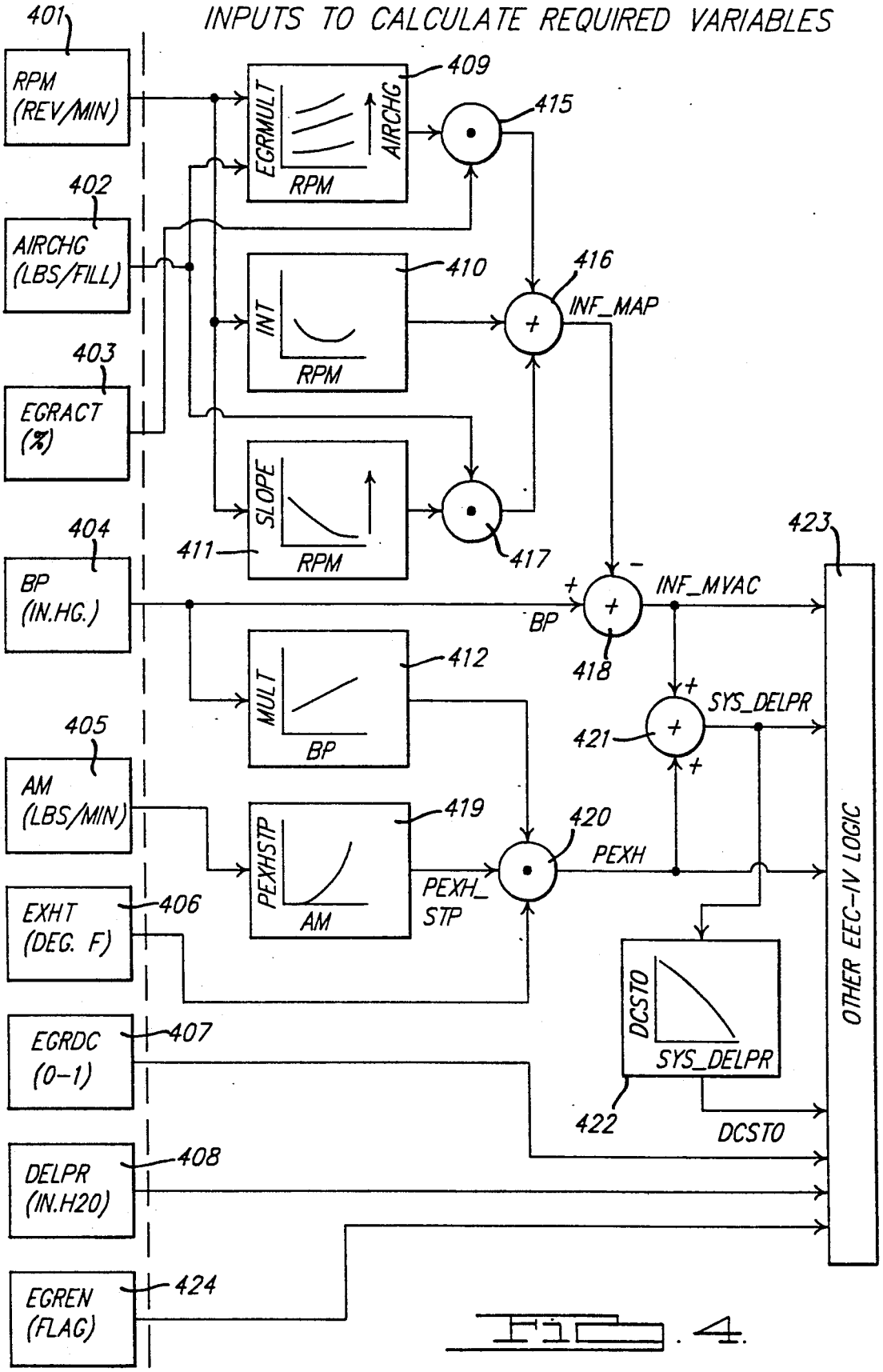
FIG. 4 is a data flow diagram of various variables required for the EGR diagnostics.

Referring to FIG. 4, a block diagram shows the method of calculating various variables required for EGR diagnostics. This is a detailed explanation of the logic of block 302 in FIG. 3A. The diagram includes inputs identifying engine speed (401), air charge (402), exhaust gas recirculation actual percentage (403), barometric pressure (404), air mass (405) and exhaust temperature (406).

In particular, an electronic control module logic flow includes inputs indicating engine RPM 401, intake air charge AIRCHG 402, exhaust gas recirculation percent EGRACT 403, barometric pressure BP 404, EGR orifice delta pressure DELPR 407, command EGR electronic vacuum regulator duty cycle EGRDC 408, and a variable indicating that a non-zero value of EGR is desired EGREN input 424. Stored look-up tables indicating various engine parameters include a constant EGRMULT versus RPM and AIRCHG in table 409, a constant INT versus RPM in table 410, a constant SLOPE versus RPM in table 411, a constant MULT versus BP in table 412, a constant PEXHSTP versus AM in table 419.

Referring to FIG. 4, a block 409 is an adjustment to inferred manifold pressure (INF_MAP) per percent EGR for engine rpm input 401 and AIRCHG input 402. The output of block 409 is applied to a multiplier 415 which also has input from EGRACT input 403. A block 410 is an adjustment to inferred manifold pressure for engine RPM input 401. A block 411 is an adjustment to inferred manifold pressure per unit of AIRCHG for RPM input 401. The output of block 411 is applied to multiplier 417 which also has input from AIRCHG input 402. A summer 416 has inputs from multiplier 415, block 410, and multiplier 417 to provide inferred manifold pressure INF_MAP.

A multiplier 418 has input from BP input 404 and INF_MAP from summer 416 to provide inferred manifold vacuum INF_MVAC. A block 412 is an adjustment to exhaust backpressure for BP input 404. A block 419 is inferred exhaust backpressure at standard temperature and pressure, PEXH_STP and has input from AM input 405. A multiplier 420 has input from block 412, block 419, and EXHT input 406 to provide exhaust pressure corrected for temperature and barometric pressure PEXH. A summer 421 has inputs from summer 418 and multiplier 420 to provide total pressure drop across the EGR system, SYS_DELPR. A block 422 has input from summer 421 to provide duty cycle start to open value DCSTO. A block 423 represents other EEC-IV logic and has inputs INF_MVAC from summer 418, SYS_DELPR from summer 421, PEXH from multiplier 420, DCSTO from block 422, EGRDC from input 407, DELPR from input 408, and EGREN from input 424.

In summary, the diagram includes stored look-up tables including engine speed versus EGR multiplier at various air charges (a block 409), engine speed versus INT (a block 410), engine speed versus slope (a block 411), barometric pressure versus a multiplier (a block 412) and air mass versus PEXHSTP (a block 419) where PEXHSTP is the exhaust pressure at 29.92 barometric pressure and 1000 Deg. F. exhaust temperature. Calculation in accordance with the diagram includes:

1) applying inputs indicating engine speed to block 409, block 410 and block 414;
2) applying an input indicating air charge to block 409;
3) applying an input indicating barometric pressure to block 412;
4) applying air mass to block 419;
5) applying the output from block 409 and an input indicating exact actual exhaust gas circulation to a multiplier 415;
6) applying the output of table 411 to a multiplier 417 and applying input 402 indicating air charge to multiplier 417;
7) applying the output from multiplier 415, multiplier 417 and block 410 to a summer 416;
8) applying the output of summer 416 to the negative input of a summer 418 and applying input 404 indicating barometric pressure to a positive input of summer 418;
9) applying the outputs of tables 412 and 419 to a multiplier 420 and applying input 406 indicating exhaust temperature to multiplier 420;
10) applying the outputs of summer 418 and multiplier 420 to a summer 421; applying the output of summer 421 to a block 422 relating system delta pressure to DCSTO. The calculation shown in the diagram furnished provides a DCSTO output from table 422 and a system delta pressure output from summer 421 where DCSTO is the EGR duty cycle EGRDC required overcome the spring force which keeps the EGR valve closed on its seat, versus the pressure drop across the EGR seat which is SYS_DELPR.

Figure 5:
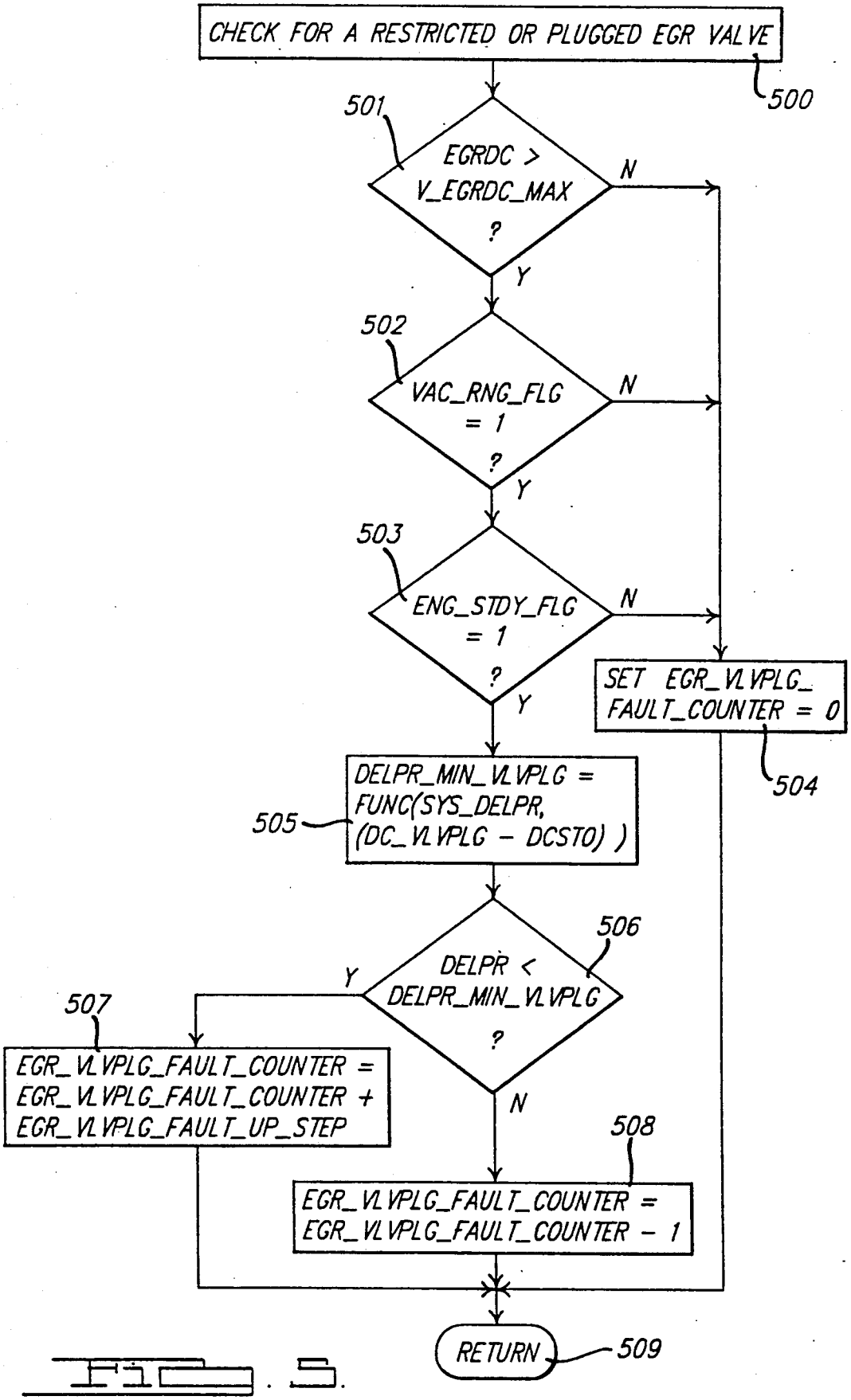
FIG. 5 is a logic flow diagram for the method of detecting a restricted or plugged EGR valve.

Referring to FIG. 3B, block 323, logic then flows to FIG. 5, block 500, wherein logic to check for a restricted or plugged EGR valve is initiated. Logic then flows to decision block 501, where a comparison is made between EGRDC input 407 and calibration variable V_EGRDC_MAX. If EGRDC is not greater than V_EGRDC_MAX then logic flows to block 504 where variable EGR_UPHOSE_FAULT_COUNTER is set to zero, indicating that fault detection cannot take place. Then logic flow to block 509, a return to the main logic diagram in FIG. 3*b*, block 323. If EGRDC is greater than V_EGRDC_MAX then logic flows to decision block 502.

In decision block 502, a comparison is made between calculated variable VAC_RNG_FLG and the constant 1. If VAC_RNG_FLG equals 1, then logic flows to decision block 503.

In decision block 503, a comparison is made between calculated variable ENG_STDY_FLG and the constant 1. If ENG_STDY_FLG is not equal to 1, then logic flows to block 504. If ENG_STDY_FLG equals 1, then logic flows to block 505.

In block 505, variable DELPR_MIN_VLVPLG is calculated from the DELPR_NORM function, shown in FIG. 2*a*, as a function of calculated variable SYS_DELPR, calculated variable DCSTO, and calibration variable DC_VLVPLG, resulting is the minimum expected delta pressure for a properly functioning EGR valve at EGR duty cycle greater than V_EGRDC_MAX.

Logic then flows to decision block 506 where a comparison is made between DELPR input 408 and calculated variable DELPR_MIN VLVPLG. If DELPR is not less than DELPR_MIN_VLVPLG then logic flows to block 508 where variable EGR_VLVPLG_FAULT_COUNTER is decremented by the constant 1.00, since a fault was not indicated for this loop through the logic. Logic then flows to block 509. If DELPR is less than DELPR_MIN_VLVPLG, then logic flows to block 507 where variable EGR_VLVPLG_FAULT_COUNTER is incremented by calibration variable EGR_VLVPLG_UP_STEP, since a fault was indicated this loop through the logic. Logic then flows to block 509.

Figure 6:
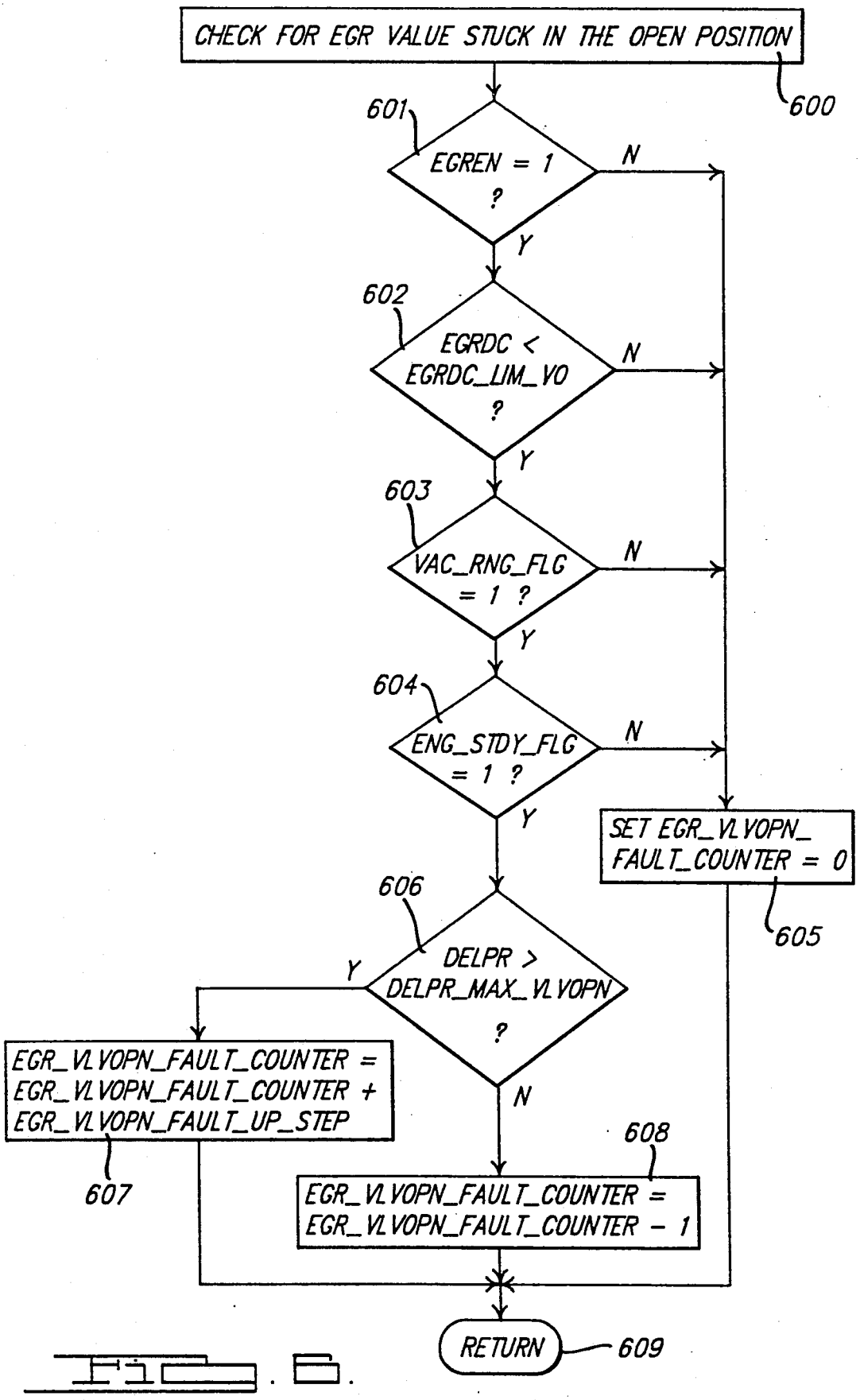
FIG. 6 is a logic flow diagram for the method of detecting an EGR valve stuck in the open position.

Referring to FIG. 3B, block 324, logic then flows to FIG. 6, block 600, wherein logic to check for a EGR valve stuck in the open position is initiated. Logic then flows to decision block 601, where a comparison is made between EGREN input 424 and the constant 1.0. If EGREN is not equal to 1.0, then logic flows to block 605 where variable EGR_VLVOPN_FAULT_COUNTER is set to zero, indicating that fault detection cannot take place. Then logic flow to block 609, a return to the main logic diagram in FIG. 3*b*, block 324. If DELPR is equal to 1.0 then logic flows to decision block 602.

In decision block 604 a comparison is made between EGRDC input 407 and calibration variable EGRDC_LIM_VO. If EGRDC is not less than EGRDC_LIM_VO then logic flows to block 605. If EGRDC is less than EGRDC_LIM_VO then logic flows to decision block 603.

In decision block 603, a comparison is made between calculated variable VAC_RNG_FLG and the constant 1. If VAC_RNG_FLG is not equal to 1, then logic flows to block 605. If VAC_RNG_FLG equals 1, then logic flows to decision block 604.

In decision block 604, a comparison is made between calculated variable ENG_STDY_FLG and the constant 1. If ENG_STDY_FLG is not equal to 1, then logic flows to block 605. If ENG_STDY_FLG equals 1, then logic flows to decision block 606.

In decision block 606, a comparison is made between EGRDC input 407 and calibration variable DELPR_MAX_VLVOPN. If DELPR is not greater than DELPR_MAX_VLVOPN then logic flows to block 608 where variable EGR_VLVOPN_FAULT_COUNTER is decremented by the constant 1.0, since a fault was not indicated for this loop through the logic. Logic then flows to block 609. If DELPR is greater than DELPR_MIN_VLVOPN, then logic flows to block 607 where variable EGR_VLVOPN_FAULT_COUNTER is incremented by calibration variable EGR_VLVOPN_UP_STEP, since a fault was indicated this loop through the logic. Logic then flows to block 609.

Figure 7:
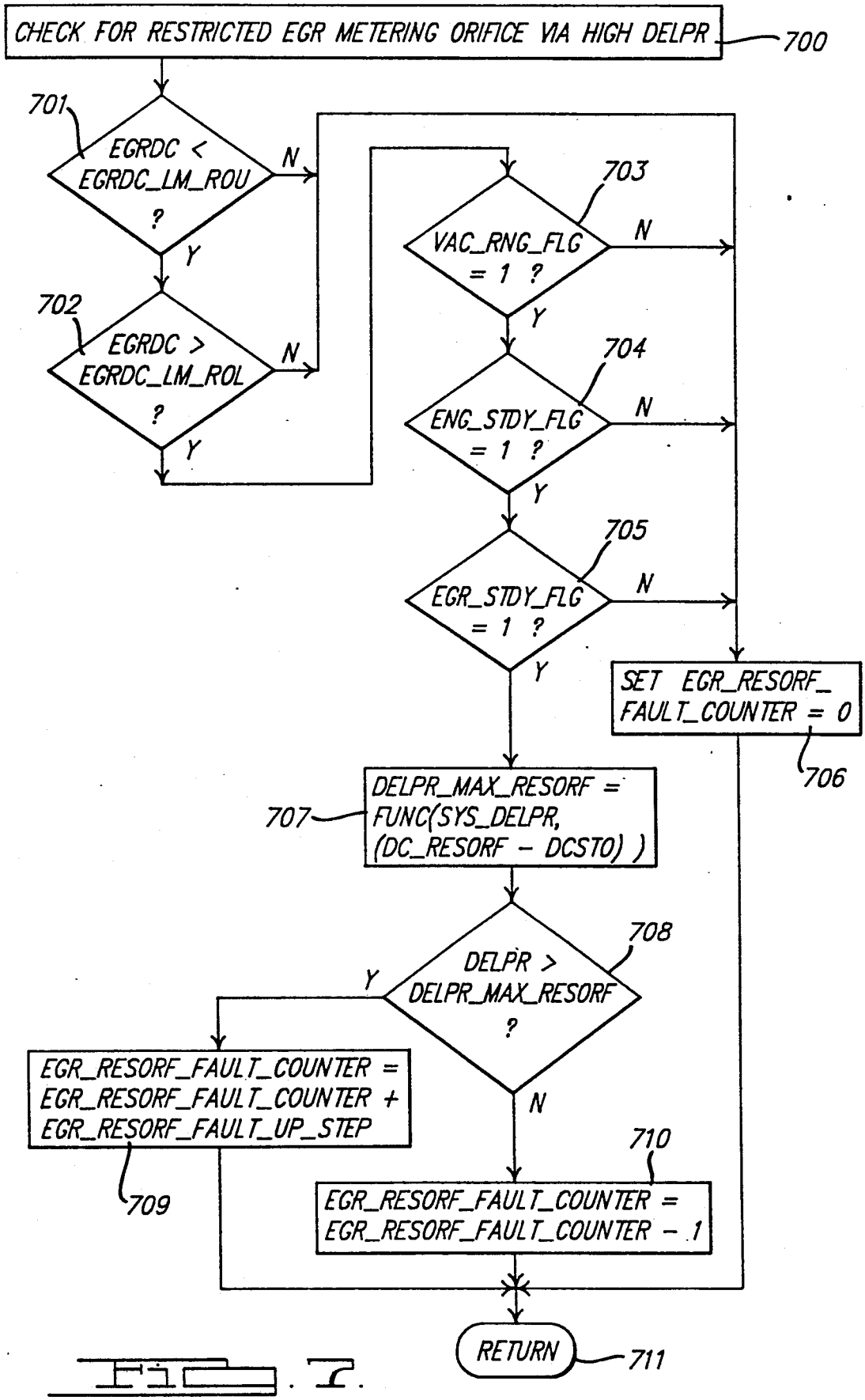
FIG. 7 is a logic flow diagram for the method of detecting a restricted EGR metering orifice via higher than normal delta pressure.

Referring to FIG. 3B, block 325, logic then flows to FIG. 7, block 700, wherein logic to check for a restricted EGR metering orifice via high DELPR is initiated.

In decision block 701 a comparison is made between EGRDC input 407 and calibration variable EGRDC_LM_ROU. If EGRDC is not less than EGRDC_LM_ROU then logic flows to block 706 where variable EGR_RESORF_FAULT_COUNTER is set to zero, indicating that fault detection cannot take place. Then logic flows to block 711, a return to the main logic diagram in FIG. 3*b*, block 325. If EGRDC is less than EGRDC_LM_ROU then logic flows to decision block 702.

In decision block 702 a comparison is made between EGRDC input 407 and calibration variable EGRDC_LM_ROL. If EGRDC is greater than EGRDC_LM_ROL then logic flows to decision block 703. If EGRDC is not greater logic flow goes to block 706.

In decision block 703, a comparison is made between calculated variable VAC_RNG_FLG and the constant 1. If VAC_RNG_FLG equals 1, then logic flows to decision block 704. If not equal to 1, then logic flows to block 706.

In decision block 704, a comparison is made between calculated variable ENG_STDY_FLG and the constant 1. If ENG_STDY_FLG is not equal to 1, then logic flows to block 706. If ENG_STDY_FLG equals 1, then logic flows to decision block 705.

In decision block 705, a comparison is made between calculated variable EGR_STDY_FLG and the constant 1. If EGR_STDY_FLG is not equal to 1, then logic flows to block 706. If EGR_STDY_FLG equals 1, then logic flows to decision block 707.

In block 707, variable DELPR_MAX_RESORF is calculated from the DELPR_NORM function, shown in FIG. 2A, as a function of calculated variable SYS_DELPR, calculated variable DCSTO, and calibration variable DC_RESORF, resulting is the maximum expected delta pressure for a properly functioning EGR valve at EGR duty cycle less than EGRDC_LM_ROU. Logic then flows to decision block 708.

In decision block 708, a comparison is made between DELPR input 408 and calculated variable DELPR_MAX_RESORF. If DELPR is not greater than DELPR_MAX_RESORF then logic flows to block 710 where variable EGR_RESORF_FAULT_COUNTER is decremented by the constant 1.0, since a fault was not indicated for this loop through the logic. Logic then flows to block 711. If DELPR is greater than DELPR_MAX_RESORF, then logic flows to block 709 where variable EGR_RESORF_FAULT_COUNTER is incremented by calibration variable EGR_RESORF_UP_STEP, since a fault was indicated this loop through the logic. Logic then flows to block 711.

Figure 8A:
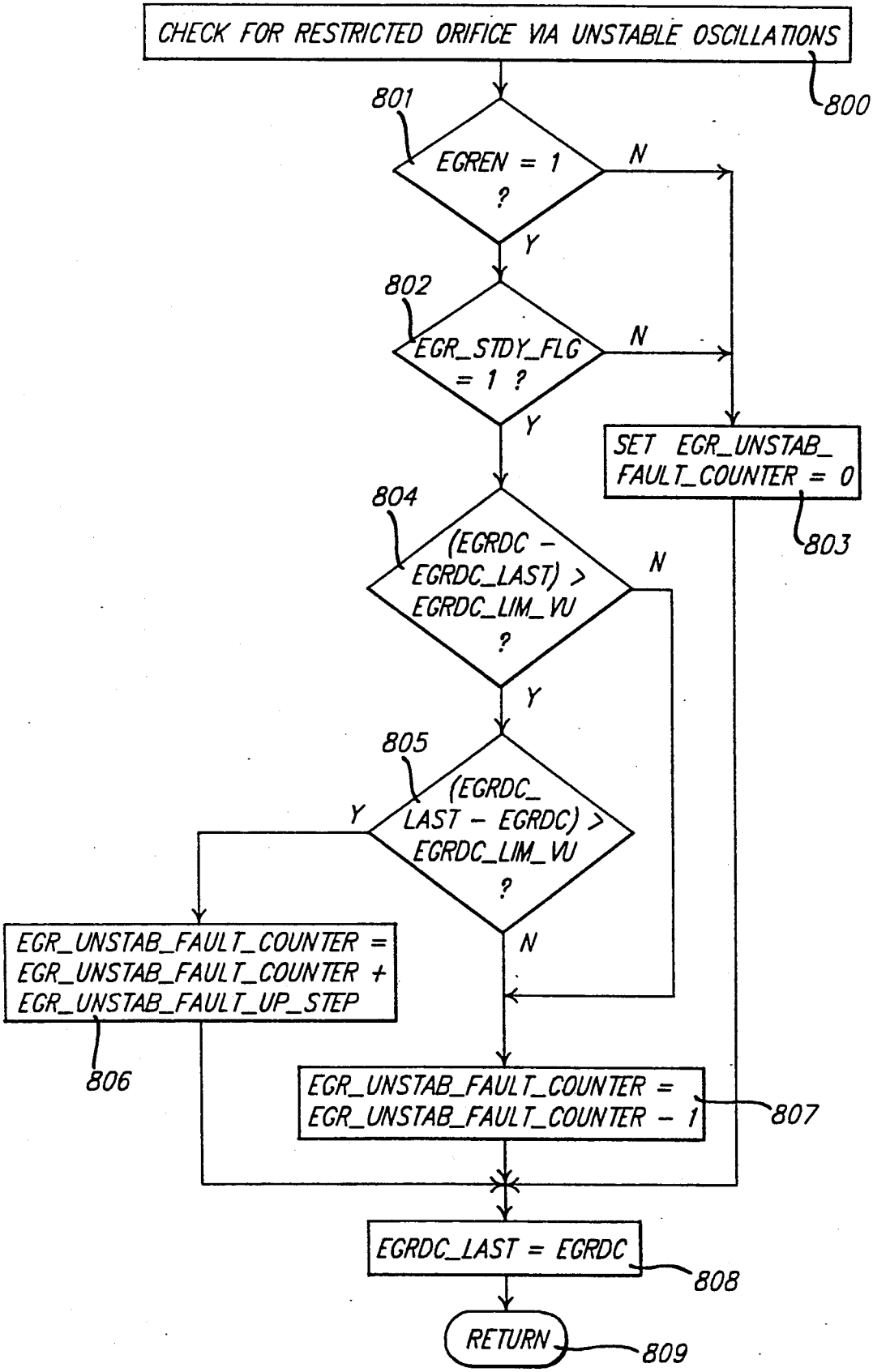
FIG. 8A is a logic flow diagram for the method of detecting a restricted EGR metering orifice via oscillations in the EGR duty cycle.

Referring to FIG. 3B, block 326, logic then flows to FIG. 8A, block 800, wherein logic to check for a restricted EGR metering orifice via oscillations in the EGR duty cycle is initiated. Logic then flows to decision block 801, where a comparison is made between EGREN input 424 and the constant 1.0. If EGREN is not equal to 1.0, then logic flows to block 803 where variable EGR_UNSTAB_FAULT_COUNTER is set to zero, indicating that fault detection cannot take place. Then logic flows to block 808, where variable EGRDC_LAST is set equal to EGRDC input 407 for use on the next loop through the logic in block 804. Logic then flows to block 809, a return to the main logic diagram in FIG. 3*b*, block 326. If EGREN is equal to 1.0 then logic flows to decision block 802.

In decision block 802, a comparison is made between calculated variable EGR_STDY_FLG and the constant 1. If EGR_STDY_FLG is not equal to 1.0, then logic flows to block 803. If EGR_STDY_FLG is equal to 1.0, then logic flows to decision block 804.

In block 804, the difference between EGRDC input 407 and calculated variable EGRDC LAST, from block 808, is compared to calibration variable EGRDC_LIM_VU. If the quantity (EGRDC—EGRDC_LAST) is not greater than EGRDC_LIM_VU then logic flows to block 807, where variable EGR_RESORF_FAULT. COUNTER is decremented by the constant 1.0, since a fault was not indicated for this loop through the logic. Logic then flows to block 808 and to block 809. If the quantity (EGRDC—EGRDC_LAST) is greater than EGRDC_LIM_VU then logic flows to block 805.

In block 805, the difference between calculated variable EGRDC_LAST and EGRDC input 407 is compared to calibration variable EGRDC_LIM_VU. If the quantity (EGRDC_LAST—EGRDC) is not greater than EGRDC_LIM_VU then logic flows to block 807. If the quantity (EGRDC_LAST—EGRDC) is greater than EGRDC_LIM_VU then logic flows to block 806, where variable EGR_RESORF_FAULT_COUNTER is incremented by calibration variable EGR_RESORF_UP_STEP, since a fault was indicated this loop through the logic. Logic then flows to block 808 and to block 809.

Figure 9A:
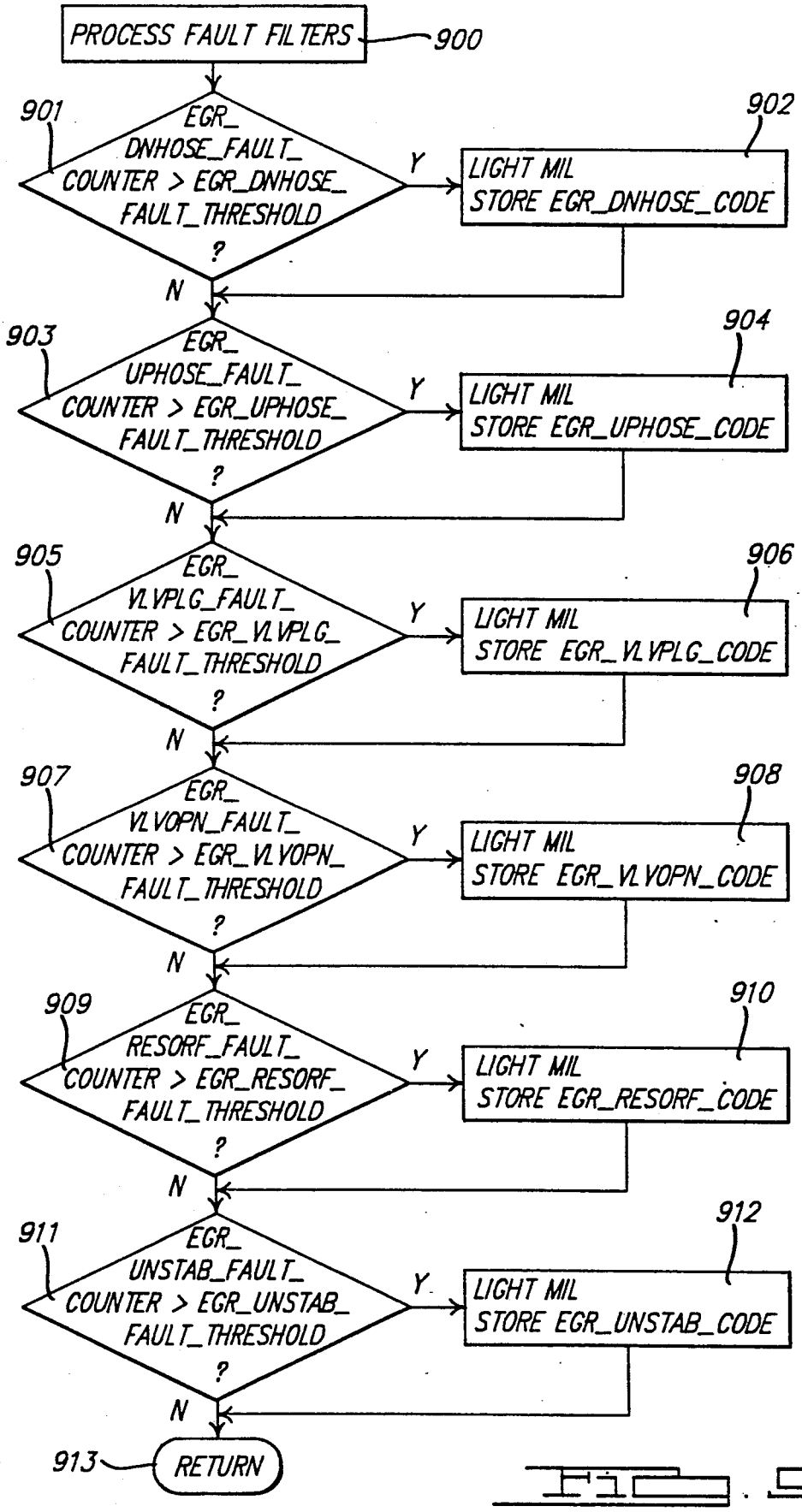
FIG. 9A is the logic used to process the fault filters and determine if the malfunction indicator light should be illuminated.

Referring to FIG. 3C, block 327, logic then flows to FIG. 9A block 900, wherein logic to process fault filters is initiated.

Logic then flows to decision block 901, where a comparison is made between calculated variable EGR_DNHOSE_FAULT_COUNTER, from FIG. 3*d* blocks 335 and 336, and calibration variable EGR_DNHOSE_FAULT_THRESHOLD. If EGR_DNHOSE_FAULT_COUNTER is greater than EGR_DNHOSE_FAULT_THRESHOLD then logic flows to block 902, wherein EEC-IV logic to illuminate the malfunction indicator light, MIL, is implemented and calibration variable EGR_DNHOSE_CODE is stored in computer keep alive memory, KAM, for access by a service technician. Logic then flows to block 903. If EGR_DNHOSE_FAULT_COUNTER is less than EGR_DNHOSE_FAULT_THRESHOLD then logic flows to block 903.

In block 903 a comparison is made between calculated variable EGR_UPHOSE_FAULT_COUNTER, from FIG. 3E blocks 345 and 346, and calibration variable EGR_UPHOSE_FAULT_THRESHOLD. If EGR_UPHOSE_FAULT_COUNTER is greater than EGR_UPHOSE_FAULT_THRESHOLD then logic flows to block 904, wherein EEC-IV MIL illumination logic is implemented and calibration variable EGR_UPHOSE_CODE is stored in KAM. Logic then flows to block 905. If EGR UPHOSE_FAULT_COUNTER is less than EGR_UPHOSE_FAULT_THRESHOLD then logic flows to block 905.

In block 905 a comparison is made between calculated variable EGR_VLVPLG_FAULT_COUNTER, from FIG. 5 blocks 507 and 508, and calibration variable EGR_LVPLG_FAULT_THRESHOLD. If EGR_VLVPLG_FAULT_COUNTER is greater than EGR_VLVPLG_FAULT_THRESHOLD then logic flows to block 906, wherein EEC-IV MIL illumination logic is implemented and calibration variable EGR_VLVPLG_CODE is stored in KAM. Logic then flows to block 907. If EGR_VLVPLG_FAULT_COUNTER is less than EGR_VLVPLG_FAULT_THRESHOLD then logic flows to block 907.

In block 907 a comparison is made between calculated variable EGR_VLVOPN_FAULT_COUNTER, from FIG. 6 blocks 607 and 608, and calibration variable EGR_VLVOPN_FAULT_THRESHOLD. If EGR_VLVOPN FAULT_COUNTER is greater than EGR_VLVOPN FAULT_THRESHOLD then logic flows to block 908, wherein EEC-IV MIL illumination logic is implemented and calibration variable EGR_VLVOPN_CODE is stored in KAM. Logic then flows to block 909. If EGR_VLVOPN_FAULT_COUNTER is less than EGR_VLVOPN_FAULT_THRESHOLD then logic flows to block 909.

In block 909 a comparison is made between calculated variable EGR_RESORF_FAULT_COUNTER, from FIG. 7 blocks 709 and 710, and calibration variable EGR_RESORF_FAULT_THRESHOLD. If EGR_RESORF_FAULT_COUNTER is greater than EGR_RESORF_FAULT_THRESHOLD then logic flows to block 910, wherein EEC-IV MIL illumination logic is implemented and calibration variable EGR_RESORF_CODE is stored in KAM. Logic then flows to block 911. If EGR_RESORF_FAULT_COUNTER is less than EGR_RESORF_FAULT_THRESHOLD then logic flows to block 911.

In block 911 a comparison is made between calculated variable EGR_UNSTAB_FAULT_COUNTER, from FIG. 8 blocks 806 and 807, and calibration variable EGR_UNSTAB_FAULT_THRESHOLD. If EGR_UNSTAB_FAULT_COUNTER is greater than EGR_UNSTAB_FAULT_THRESHOLD then logic flows to block 912, wherein EEC-IV MIL illumination logic is implemented and calibration variable EGR_UNSTAB_CODE is stored in KAM. Logic then flows to block 913, a return to the main logic diagram in FIG. 3*b*, block 327. If EGR_UNSTAB_FAULT_COUNTER is less than EGR_UNSTAB_FAULT_THRESHOLD then logic flows to block 913.

Figure 8B:
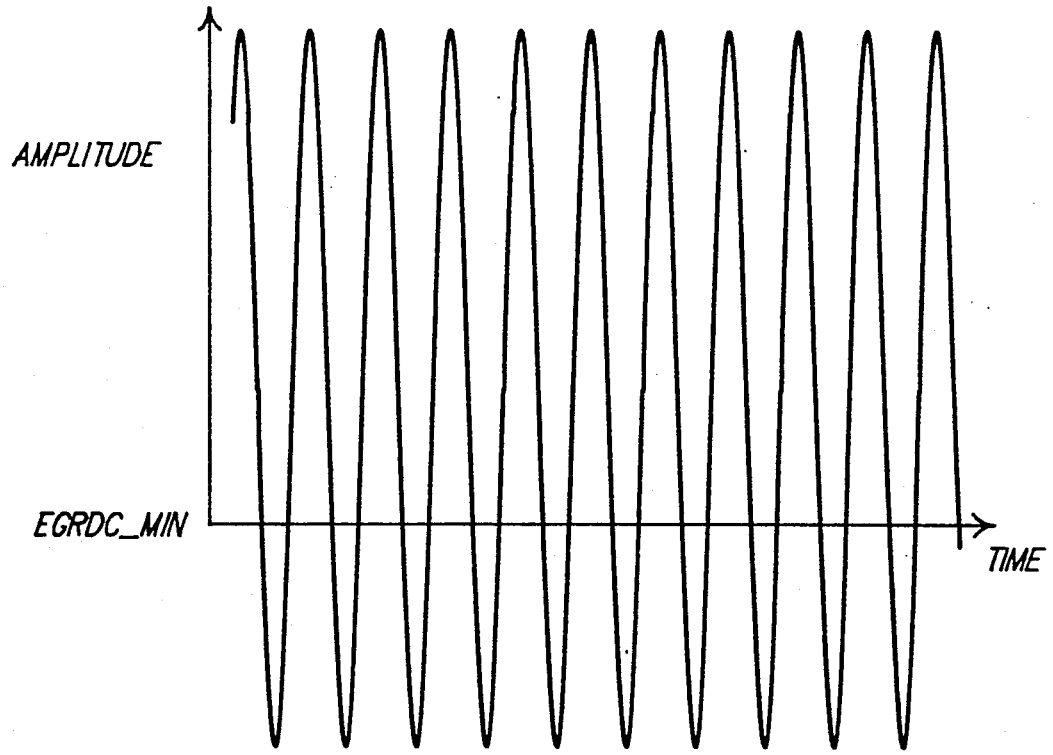
FIG. 8B is a illustration of such oscillations.
Figure 9B:
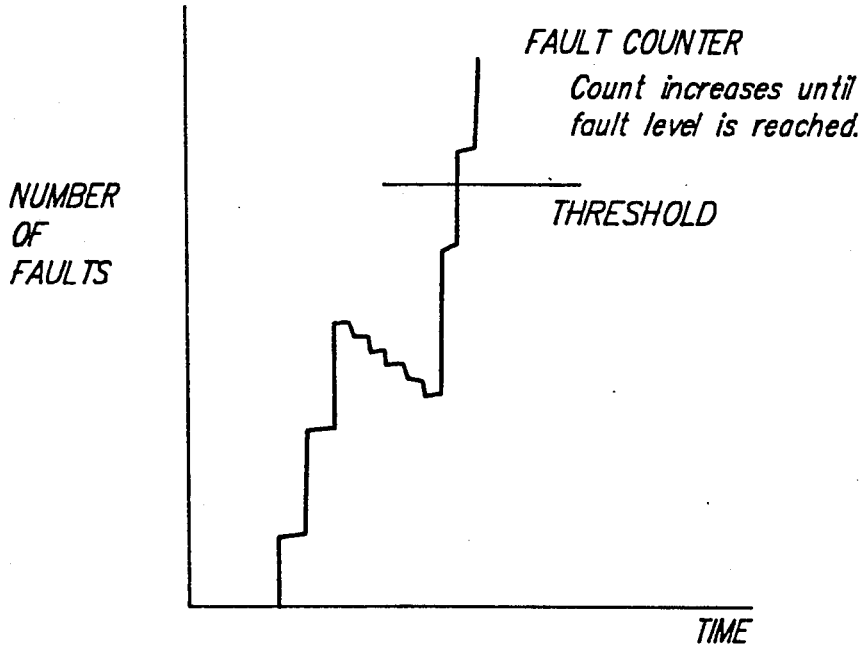
FIG. 9B is a graphical representation of the number of faults versus time.

Referring to FIG. 8B, there is a wave form shown illustrating the logic flow of portions of FIG. 8A. Referring to FIG. 9B, there is a time versus number faults diagram indicating a threshold level and illustrating portions of the logic flow of diagram of FIG. 9A.

Various modifications and variations will no doubt occur to those skilled in the art to which this invention pertains. For example, the particular components of an EGR system which are tested may be varied from those disclosed herein. These and all other similar variations come within the scope of the pending claims.

What is claimed:

1. A method of determining a fault in an EGR system includes the steps of:

comparing the measured exhaust gas flow through the EGR system to an expected EGR flow;

determining the period of time that the expected flow of EGR deviates from the measured EGR flow by a calibrated EGR flow amount; and indicating a fault condition in the EGR system if the duration of the deviation exceeds a predetermined amount of time.

2. A method as recited in claim 1 further comprising the steps of:

storing hardware characteristics in a read only memory table.

3. A method as recited in claim 1 including the steps of:

providing inputs identifying engine speed, air charge, exhaust gas recirculation actual percentage, barometric pressure, air mass and exhaust temperature;

providing stored look-up tables including engine speed versus an EGR multiplier at various air charges (a first table), engine speed versus INT (a second table), engine speed versus slope (a third table), barometric pressure versus a multiplier (a fourth table) and air mass versus PEXHSTP (a fifth table) where PEXHSTP is the exhaust pressure at 29.92 barometric pressure and 1000 Deg. F. exhaust temperature;

applying inputs indicating engine speed to said first table, said second table and said third table;

applying an input indicating air charge to said first table;

applying an input indicating barometric pressure to said fourth table;

applying air mass to said fifth table;

applying the output from said first table and an input indicating exact actual exhaust gas circulation to a first multiplier;

applying the output of said third table to a second multiplier and applying the input indicating air charge to said second multiplier;

applying the output from said first multiplier, said second multiplier and said second table to a first summer;

applying the output of the first summer to the negative input of a second summer and applying the input indicating barometric pressure to a positive input of said second summer;

applying the outputs of said fourth and fifth tables to a third multiplier and applying the input indicating exhaust temperature to said third multiplier;

applying the outputs of said second summer and said third multiplier to a third summer applying the output of said third summer to a sixth table relating system delta pressure to DCSTO; and providing a DCSTO output from said sixth table and a system delta pressure output from said third summer where DCSTO is the EGR duty cycle EGRDC required overcome the spring force which keeps the EGR valve closed on its seat, versus the pressure drop. across the EGR seat which is SYS_DELPR.

4. A method as recited in claim 1 including the steps of checking for a restricted or plugged exhaust gas recirculation valve including:

comparing EGR DC, to V_EGRDC_MAX, if it is not greater, exiting and setting EGR_VLVPLG—FAULT_COUNTER, equal to zero;

if it is greater, checking to see if a VAC_RNG_FLG is equal to one; if not, then exiting and setting EGR_VLVPLG_FAULT_COUNTER equal to zero; if yes then checking to see if ENG_STDY_FLG is equal to one;

if no then exiting and setting EGR_VLVPLG_FAULT_COUNTER equal to zero; if yes setting DELP_MIN_VLVPLG; equal to a function of SYS_DELPR, DC_VLVPLG, DCSTO;

comparing DELPR to DELPR_MIN_VLVPLG if DELPR is less, setting EGR_VLVPLG_FAULT_COUNTER equal to the previous EGR_VLVPLG_FAULT_COUNTER plus an additional step; and if not less setting EGR_VLVPLG_FAULT_COUNTER equal to the previous EGR_VLVPLG_FAULT_COUNTER less one.

5. A method as recited in claim 1 further comprising checking for an EGR valve stuck in the open position including the steps of:

checking to see if EGREN is equal to one;

if not, setting EGR_VLVOPN_FAULT_COUNTER equal to zero and exiting; if yes, checking to see if EGRDC is less than EGRDC_LIM_VO;

if not, setting the EGR_VLVOPN_FAULT_COUNTER equal to zero and exiting; if yes, checking to see if a VAC_RNG_FLG is set equal to zero;

if not, setting the EGR_VLVOPN_FAULT_COUNTER equal to zero and exiting; if yes checking to see if the ENG_STDY_FLG is set equal to one;

if not, setting the EGR_VLVOPN_FAULT_COUNTER equal to zero and exiting; if yes, comparing DELPR with respect to DELPR_MAX_VLVOPN if DELPR is greater, then EGR_VLVOPN_FAULT_COUNTER counter is equal to the previous plus a step; and if not, then EGR_VLVOPN_FAULT_COUNTER is equal to the previous less one and exiting.

6. A method as recited in claim 1 further comprising checking for restricted EGR metering orifice via high delta pressure including the steps of:

checking to see if EGRDC is less than EGRDC_LM_ROU;

if no, setting ENG_RESORF_FAULT_COUNTER equal to zero; if yes, checking to see if EGRDC is greater than EGRDC_LM_ROL;

if no, setting EGR_RESORF_FAULT_COUNTER equal to zero; if yes, checking to see if VAC_RNG_FLG equal to one;

if no, setting the EGR_RESORF_FAULT_COUNTER equal to zero; if yes, checking to see if the ENG_STDY_FLG equal to one;

if no, setting the EGR_RESORF_FAULT_COUNTER equal to zero; if yes, checking to see if the EGR_STDY_FLG is equal to one;

if no, setting the EGR_RESORF_FAULT_COUNTER equal to zero; if yes, setting DELPR_MAX_RESORF equal to a function of the SYS_DELPR and the DC_RESORF—DCSTO;

checking to see if DELPR is greater than DELPR_MAX_RESORF; if yes, setting the EGR_RESORF_FAULT_COUNTER equal to EGR_RESORF_FAULT_COUNTER plus the EGR_RESORF_FAULT_UP_STEP; and if no, setting the EGR_RESORF_FAULT_COUNTER equal to EGR_RESORF_FAULT_COUNTER minus one.

7. A method as recited in claim 1 for including the steps of checking for restricted orifice via unstable oscillations including the steps of:

checking to see if the EGREN is equal to zero;

if no, setting EGR_UNSTAB_FAULT_COUNTER equal to zero; if yes, checking to see if EGR_STDY_FLG is equal to one;

if no, setting EGR_UNSTAB_FAULT_COUNTER equal to zero; if yes, comparing the difference between EGRDC_LAST and EGRDL to EGRDL_LIM_VU;

if the first is not greater than the second, decrementing exhaust gas recirculation fault countered by one;

if the first is greater than the second, comparing the difference between EGRDG_LAST and EGRDC to EGRDC_LIM_VU;

if the first is not greater than the second, decrementing EGR_UNSTAB_FAULT_COUNTER by one; and if the first is greater than the second, setting EGR_UNSTAB_FAULT_COUNTER equal to the previous EGR_UNSTAB_FAULT_COUNTER plus a step.

8. A method of determining and following operation of an EGR system including the steps of:

determining EGR flow is between an upper and a lower limit of EGR flow magnitude;

checking for the disconnection of a downstream hose;

checking for disconnection of an upstream hose;

checking for a restricted or plugged EGR valve;

checking for an EGR valve stuck in an open position;

checking for a restricted EGR metering orifice via a delta pressure; and checking for a restricted EGR metering orifice via oscillations in an EGR duty cycle.

9. Method as recited in claim 8 wherein the steps of checking for the downstream hose is connected includes:

checking to see if EGREN equals one;

if no, setting EGR_DNHOSE_FAULT_COUNTER equal to zero; if yes, checking to see if DELPR is greater than DELPR_THRES1;

if no, decrementing the EGR_DNHOSE_FAULT_COUNTER; if yes, checking to see if DELPR is greater than the PEXH+EGRDELPR_TOL;

if no, decrementing the EGR_DNHOSE_FAULT_COUNTER; if yes, checking to see if DELPR is greater than PEXH−EGRDELPR_TOL;

if no, decrementing the DNHOSE_FAULT_COUNTER; and if yes, incrementing the EGR_DNHOSE_FAULT_COUNTER.

10. A method recited in claim 9 wherein the step of checking for upstream hose disconnection includes:

checking to see if EGRN is equal to one;

if no, setting the EGR_UPHOSE_FAULT_COUNTER equal to one; if yes, checking to see if DELPR is less than DELPR_THRES2;

if no, decrementing the EGR_UPHOSE_FAULT_COUNTER; if yes, checking to see if the DELPR is greater than PEXH+EGRDELPR_TOL;

if no, decrementing the EGR_UPHOSE_FAULT_COUNTER; if yes, checking to see if DELPR is less than PEXH−EGRDELPR_TOL;

if no, decrementing the EGR_UPHOSE_FAULT_COUNTER; and if yes, incrementing the UPHOSE_FAULT_COUNTER.

* * * * *